US011087942B2

(12) United States Patent
Kuo et al.

(10) Patent No.: US 11,087,942 B2
(45) Date of Patent: Aug. 10, 2021

(54) ELECTROMAGNETIC RELAY AND A METHOD OF MAKING THE SAME

(71) Applicant: EXCEL CELL ELECTRONIC CO., LTD., Taichung (TW)

(72) Inventors: Ming-Chang Kuo, Taichung (TW); Rong-Hong Lai, Taichung (TW)

(73) Assignee: EXCEL CELL ELECTRONIC CO., LTD., Taichung (TW)

( * ) Notice: Subject to any disclaimer, the term of this patent is extended or adjusted under 35 U.S.C. 154(b) by 81 days.

(21) Appl. No.: 16/728,057

(22) Filed: Dec. 27, 2019

(65) Prior Publication Data

US 2020/0234901 A1 Jul. 23, 2020

(30) Foreign Application Priority Data

Jan. 19, 2019 (TW) ..... 108102131

(51) Int. Cl.

| | |
|---|---|
| ***H01H 50/04*** | (2006.01) |
| ***H01H 50/18*** | (2006.01) |
| ***H01H 50/58*** | (2006.01) |
| ***H01H 49/00*** | (2006.01) |

(52) U.S. Cl.

CPC ..... *H01H 50/041* (2013.01); *H01H 49/00* (2013.01); *H01H 50/18* (2013.01); *H01H 50/58* (2013.01)

(58) Field of Classification Search

CPC ..... H01H 49/00; H01H 50/18; H01H 50/041; H01H 50/58; H01H 50/14; H01H 50/648; H01H 50/26; H01H 50/548; H01H 50/56

See application file for complete search history.

(56) References Cited

U.S. PATENT DOCUMENTS 2,504,912 A * 4/1950 Wibell ..... H01H 50/546 335/200

2008/0238591 A1 10/2008 Takano

FOREIGN PATENT DOCUMENTS

TW 476084 B 2/2002

OTHER PUBLICATIONS

Aug. 6, 2019—(TW) Search Report of TW Patent Application No. 108102131.

* cited by examiner

*Primary Examiner* — Mohamad A Musleh
(74) *Attorney, Agent, or Firm* — Banner & Witcoff, Ltd.

(57) ABSTRACT

An electromagnetic relay includes a base, an electromagnet disposed on the base, an armature unit having a magnetically attractive member magnetically attractable by the electromagnet, a movable terminal unit mounted on the armature unit and including a first terminal member and a first contact, and a stationary terminal member mounted on the base. The first terminal member is a two-piece structure composed of a spring plate and a first leg. A ratio of the thickness of the first leg to the thickness of the spring plate ranges from 2 to 4. When the electromagnet is energized and de-energized, the first contact contacts and moves away from the second contact, respectively. A method of making the electromagnetic relay is also disclosed.

10 Claims, 15 Drawing Sheets

ELECTROMAGNETIC RELAY AND A METHOD OF MAKING THE SAME

CROSS-REFERENCE TO RELATED APPLICATION

This application claims priority to Taiwanese Patent Application No. 108102131, filed on Jan. 19, 2019.

FIELD

The disclosure relates to a relay, and more particularly to an electromagnetic relay and a method of making the same.

BACKGROUND

Referring to FIGS. 1 to 3, an existing electromagnetic relay 100 uses a small current to control a large current. The electromagnetic relay 100 includes a base 10, an electromagnet 11 mounted on the base 10, a magnetically attractive member 12 magnetically attractable by the electromagnet 11, a push member 13 driven by the magnetically attractive member 12, a movable terminal member 14 connected to the push member 13 and extending through the base 10, and a stationary terminal member 15 mounted on the base 10 and spaced apart from the movable terminal member 14. When the electromagnet 11 is energized, the magnetically attractive member 12 is magnetically attracted by the electromagnet 11 and drives the push member 13 to push the movable terminal member 14 to contact the stationary member 15 so as to be in electrical conduction with each other.

However, because the movable terminal member 14 is composed of a plate body 141 and a contact 142 attached to the plate body 141, and the plate body 141 is made of a single piece having a uniform thickness and including a spring plate 143 and a leg 144, in order to maintain the resiliency of the movable terminal member 14, the thickness of the plate body 141 cannot be thickened. Therefore, a permissible current of the electromagnetic relay 100 is limited by the thickness of the movable terminal member 14 and cannot be increased.

SUMMARY

Therefore, an object of the present disclosure is to provide an electromagnetic relay that can increase a permissible current.

Accordingly, an electromagnetic relay of this disclosure includes a base, an electromagnet unit, an armature unit, a movable terminal unit and a stationary terminal member.

The electromagnet unit includes an electromagnet disposed on the base. The armature unit is movably connected to the electromagnet, and includes a magnetically attractive member magnetically attractable by the electromagnet. The movable terminal unit is mounted on the armature unit, and includes a first terminal member and a first contact disposed on the first terminal member. The first terminal member is a two-piece structure composed of a spring plate, and a first leg fixedly joined to the spring plate and extending through the base. The spring plate has an operating portion connected to the armature unit, a bent portion bent from the operating portion toward the electromagnet, and a connection portion bent from the bent portion and fixed to the first leg. The operating portion and the bent portion form therebetween a first included angle ranging from 75 degrees to 85 degrees.

The bent portion and the connection portion form therebetween a second included angle ranging from 80 degrees to 95 degrees. The first leg has a thickness greater than a thickness of the spring plate. A ratio of the thickness of the first leg to the thickness of the spring plate ranges from 2 to 4. The stationary terminal member is mounted on the base and partly extends through the base. The stationary terminal member has a second contact facing and contactable with the first contact.

When the electromagnet is energized and drives the armature unit to push the spring plate, the spring plate resiliently moves toward the stationary terminal member, and the first contact contacts the second contact. When the electromagnet is de-energized, the first contact moves away from the second contact.

Another object of this disclosure is to provide a method of making the electromagnetic relay that can increase a permissible current.

Accordingly, a method of making the electromagnetic relay of this disclosure includes the step of preparing a mold assembly that includes a mold, and a punch movable relative to the mold, the punch having at least one stamping head; preparing and positioning the first leg on the mold; preparing the spring plate having the connection portion; disposing the spring plate on the mold in such a manner that the connection portion of the spring plate is stacked on the first leg; driving the punch to move the stamping head toward the mold and to stamp the spring plate against the first leg, thereby joining the spring plate to the first leg to form the first terminal member; attaching the first contact to the first terminal member for forming a movable terminal unit; preparing the base, the electromagnet, the armature unit and the stationary terminal member; and assembling together the base, the electromagnet, the armature unit, the first terminal unit and a stationary terminal member.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 4:
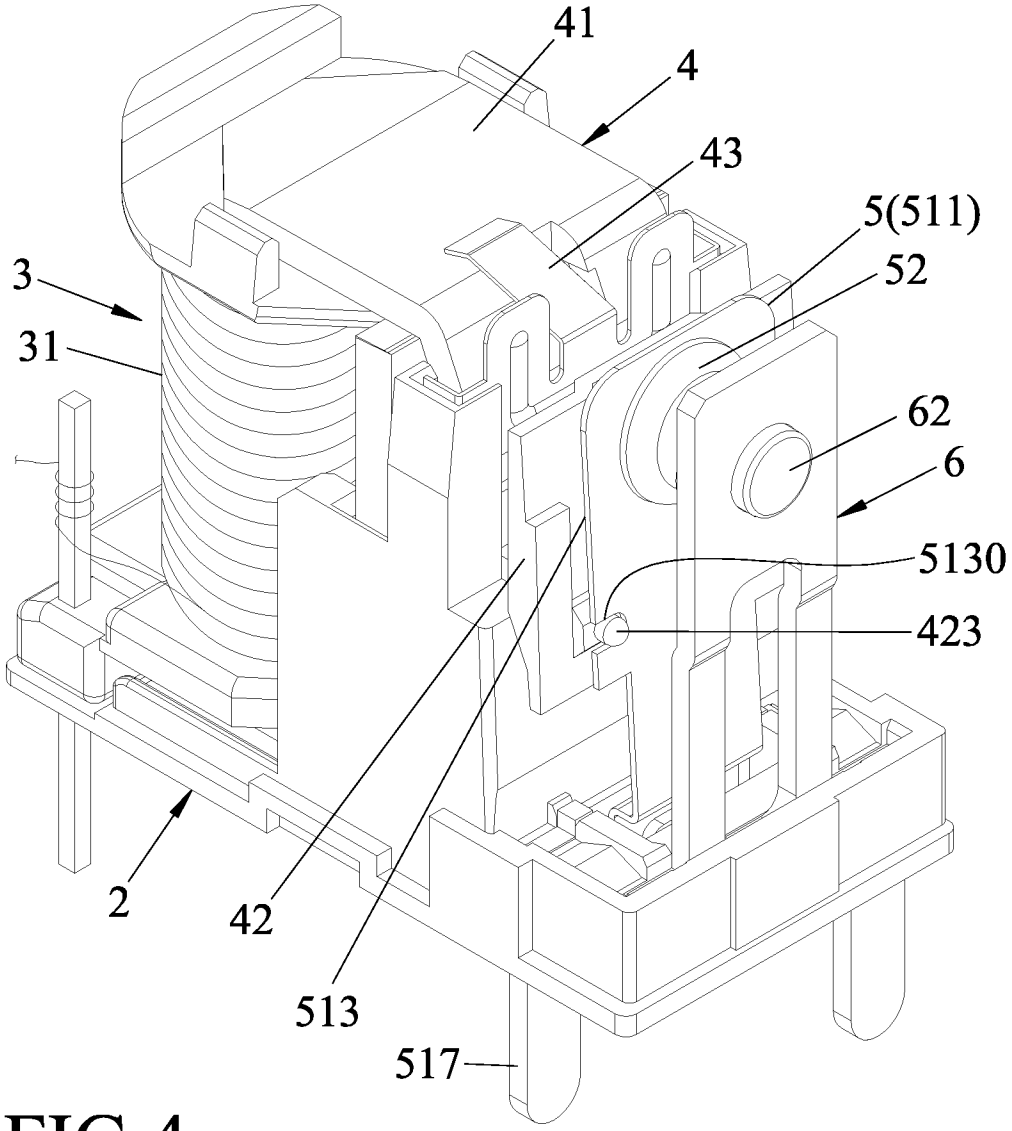
FIG. 4 is a perspective view of an electromagnetic relay according to an embodiment of the present disclosure.
Figure 5:
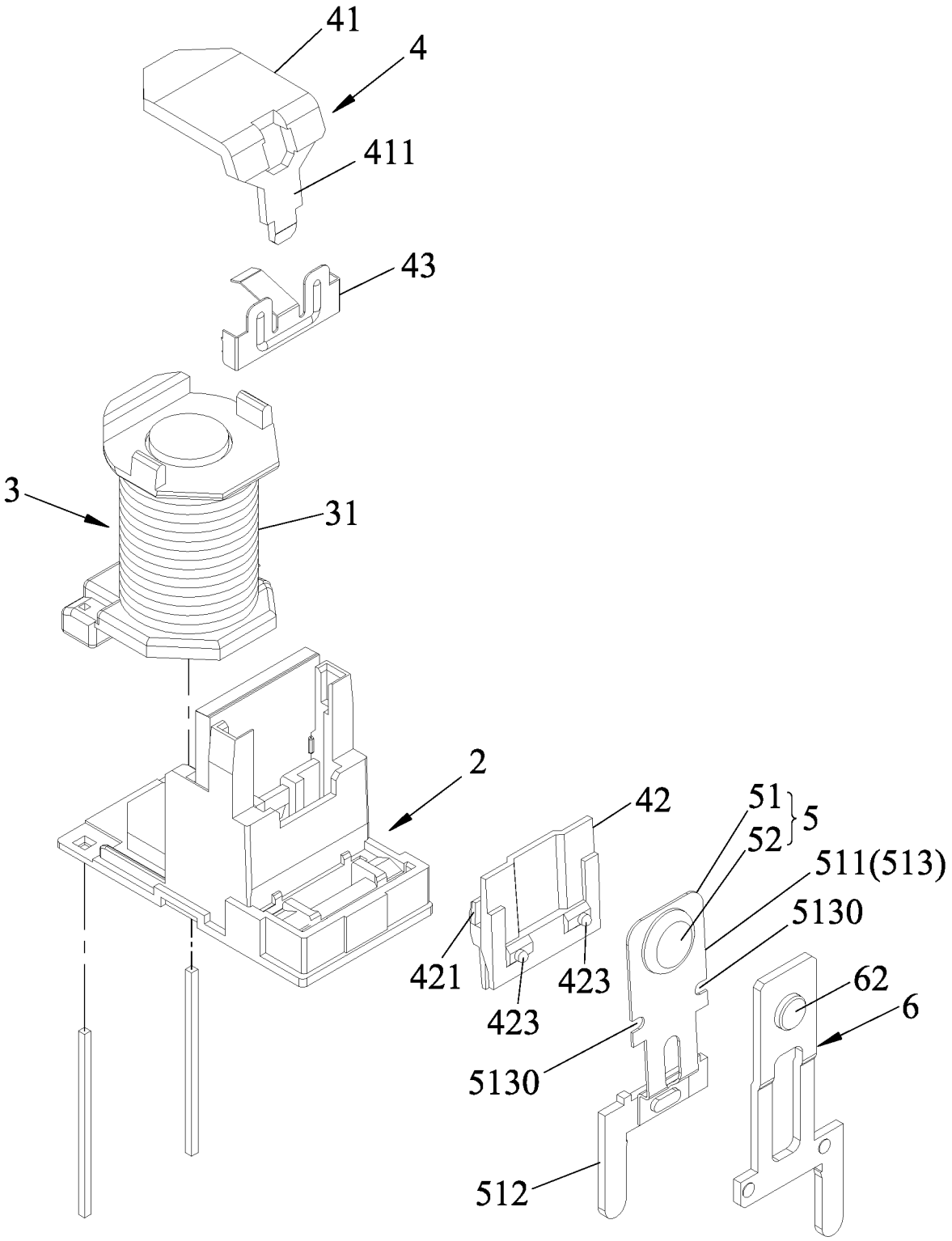
FIG. 5 is an exploded perspective view of the embodiment.

Referring to FIGS. 4 and 5, an electromagnetic relay according to an embodiment of the present disclosure includes abase 2, an electromagnet unit 3, an armature unit 4, a movable terminal unit 5 and a stationary terminal member 6.

The electromagnet unit 3 includes an electromagnet disposed on the base 2 for generating an electromagnetic force when energized.

The armature unit 4 is movably connected to the electromagnet 31, and includes a magnetically attractive member 41, a push member 42 and a resilient member 43. The magnetically attractive member 41 is magnetically attractable by the electromagnet 31, and has an insert portion 411. The push member 42 is connected to the magnetically attractive member 41 and is spaced apart from the electromagnet 31. The resilient member 43 is resiliently disposed on the magnetically attractive member 41 and extends through the base 2. The push member 42 has an insert slot 421 provided on one side thereof for insertion of the insert portion 411 therein, and two spaced-apart positioning studs 423 protruding from the other side thereof and opposite to the insert slot 421. The resilient member 43 is a metal elastic sheet that biases the magnetically attractive member 41 to move away from the electromagnet 31.

Figure 6:
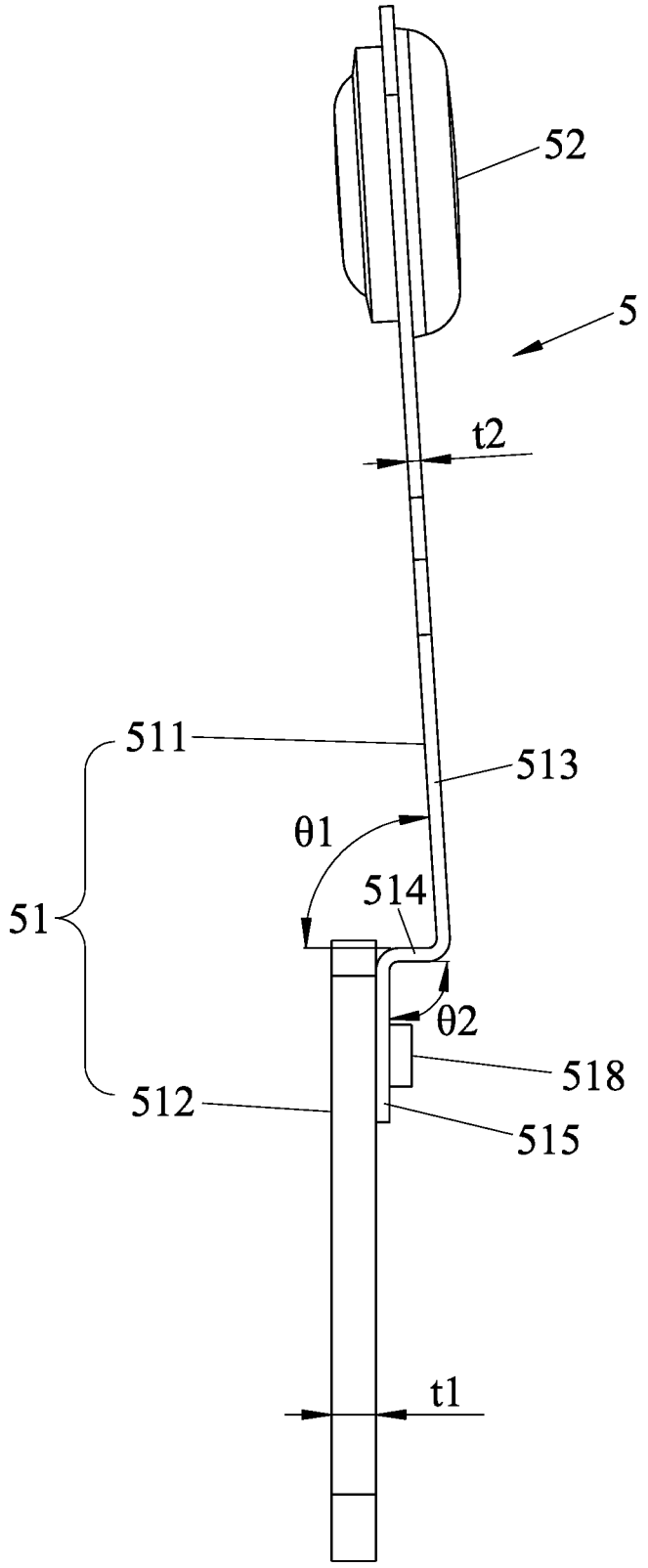
FIG. 6 is a side view of a movable terminal unit of the embodiment.
Figure 7:
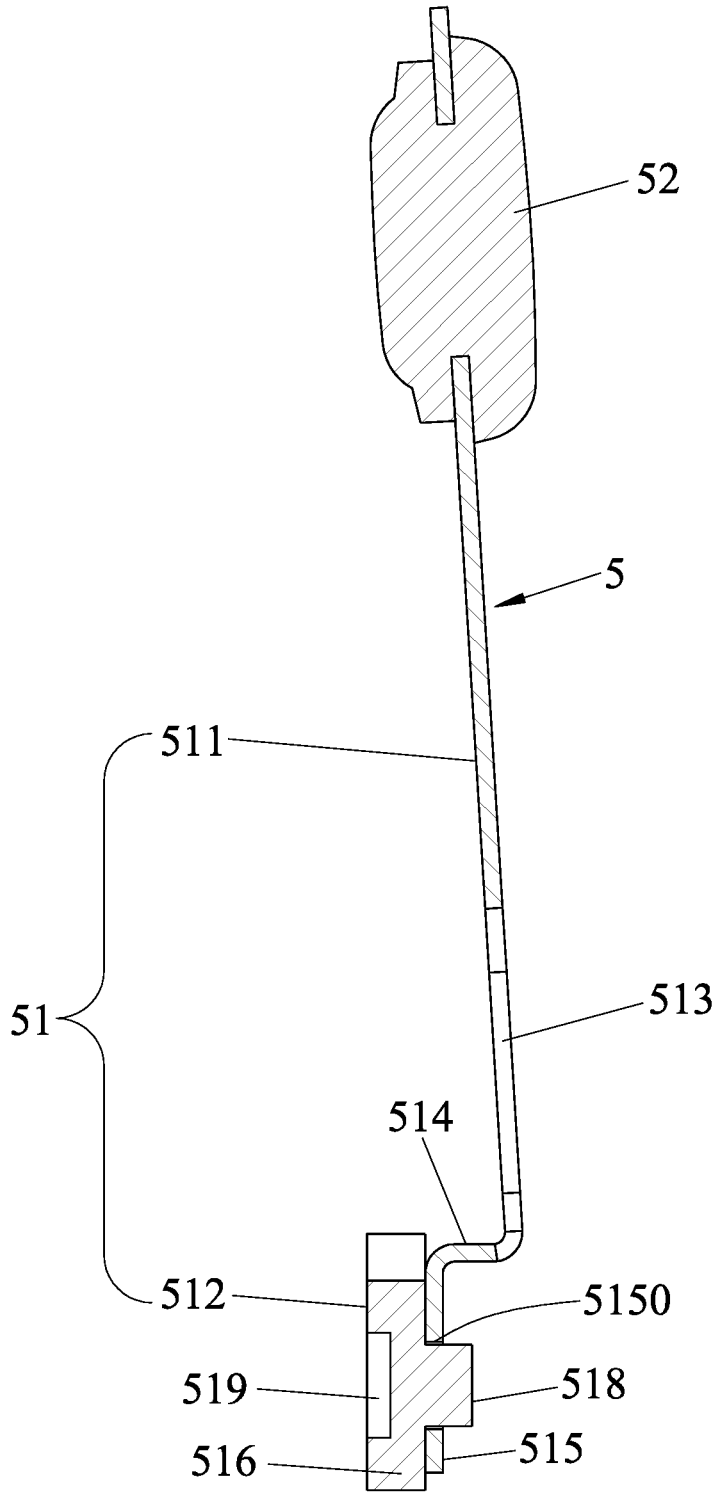
FIG. 7 is a sectional view taken from FIG. 6.
Figure 8:
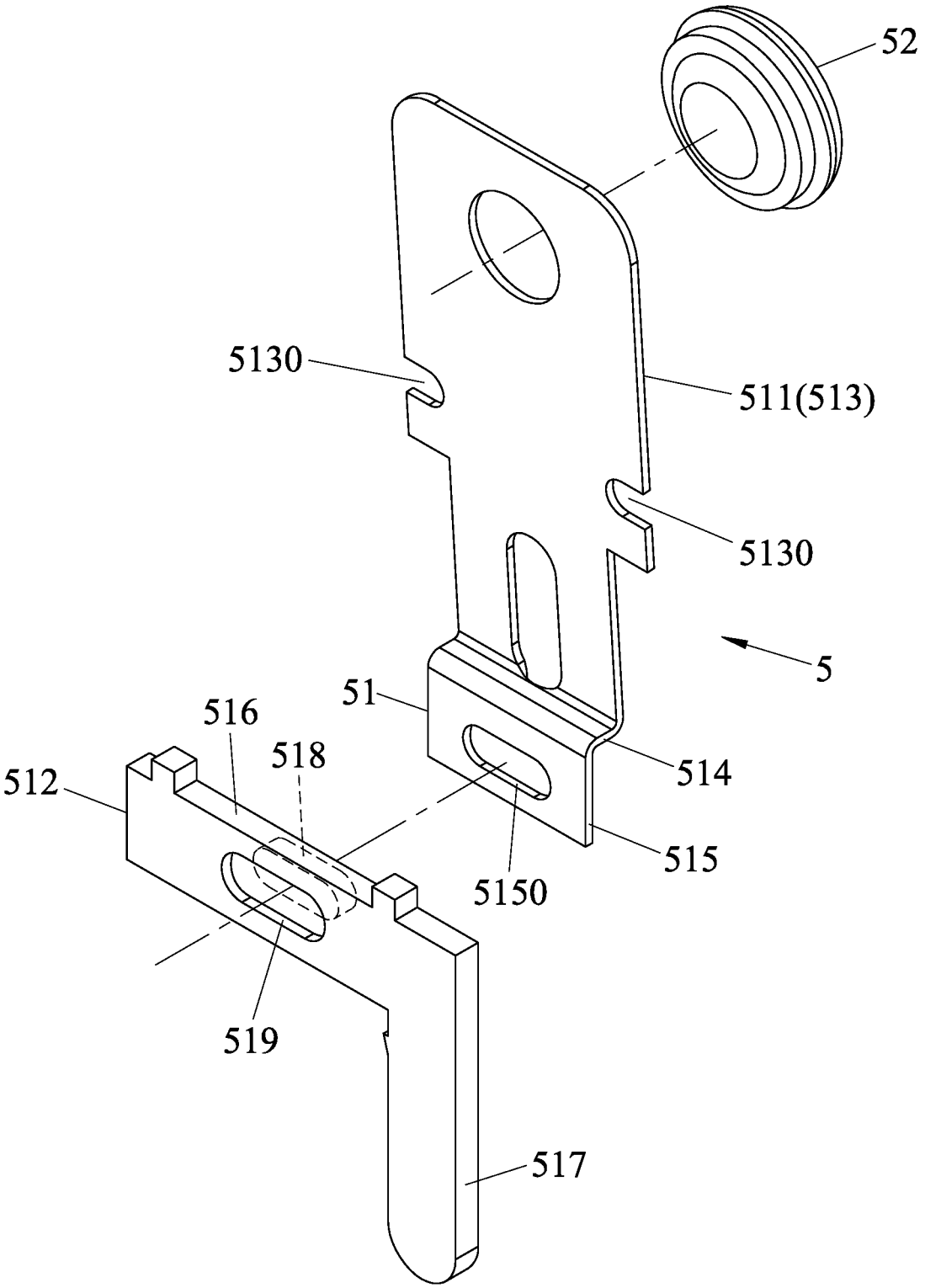
FIG. 8 is an exploded perspective view of the movable terminal unit of the embodiment.

Referring to FIGS. 6 to 8, in combination with FIG. 4, the movable terminal unit 5 is mounted on the armature unit 4, and includes a first terminal member 51 and a first contact 52. The first terminal member 51 is a two-piece structure composed of a spring plate 511, and a first leg 512 fixedly joined to the spring plate 511 and extending through the base 2. The spring plate 511 has an operating portion 513, a bent portion 514, and a connection portion 515. The first contact 52 is attached to the operating portion 513. The operating portion 513 has two receiving grooves 5130 respectively formed in two opposite sides of the spring plate 511 and respectively engaging with the positioning studs 423. The bent portion 514 is bent from the operating portion 513 toward the electromagnet 3. The connection portion 515 is bent from the bent portion 514, and is fixed to the first leg 512. The connection portion 515 has at least one engaging hole 5150. As shown in FIG. 8, the number of the engaging hole 5150 in this embodiment is one, but may be two, three or more than three in other embodiment. The operating portion 513 and the bent portion 514 form therebetween a first included angle (θ1) ranging from 75 degrees to 85 degrees. The bent portion 514 and the connection portion 515 form therebetween a second included angle (θ2) ranging from 80 degrees to 95 degrees. In this embodiment, the first included angle (θ1) is 85 degrees, while the second included angle (θ2) is 90 degrees. Through this, the spring plate 511 has resiliency and can be resiliently pushed.

Figure 1:
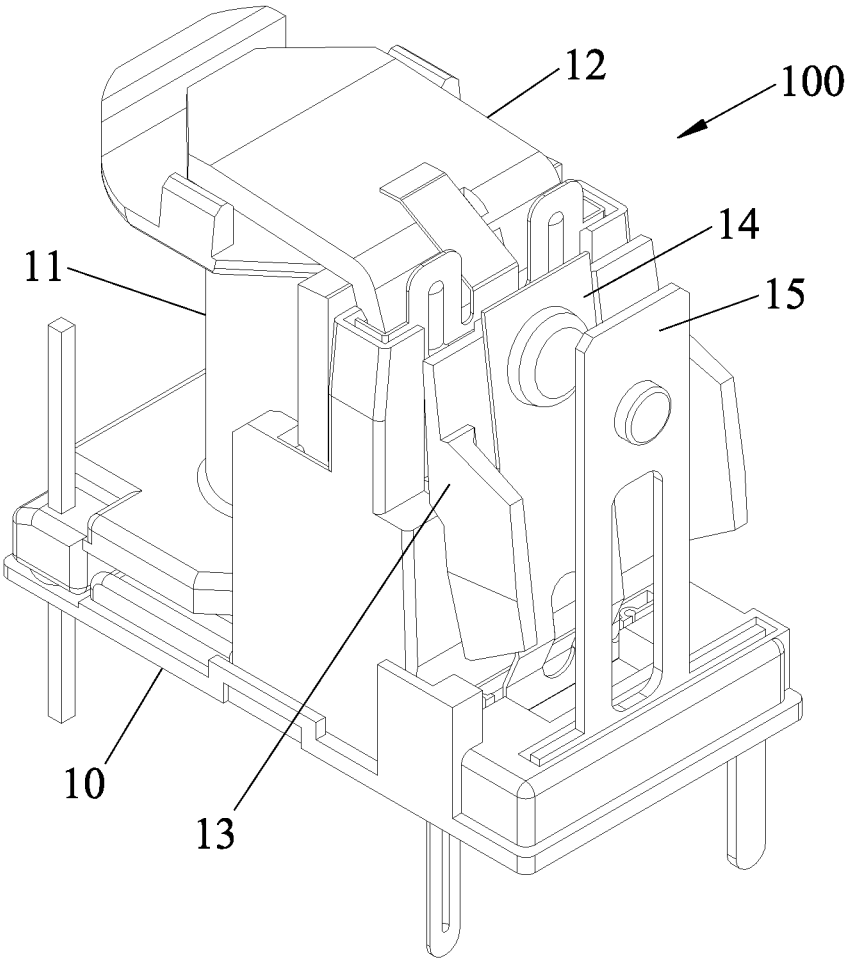
FIG.1 PRIOR ART
FIG. 1 is a perspective view of an existing electromagnetic relay.
Figure 2:
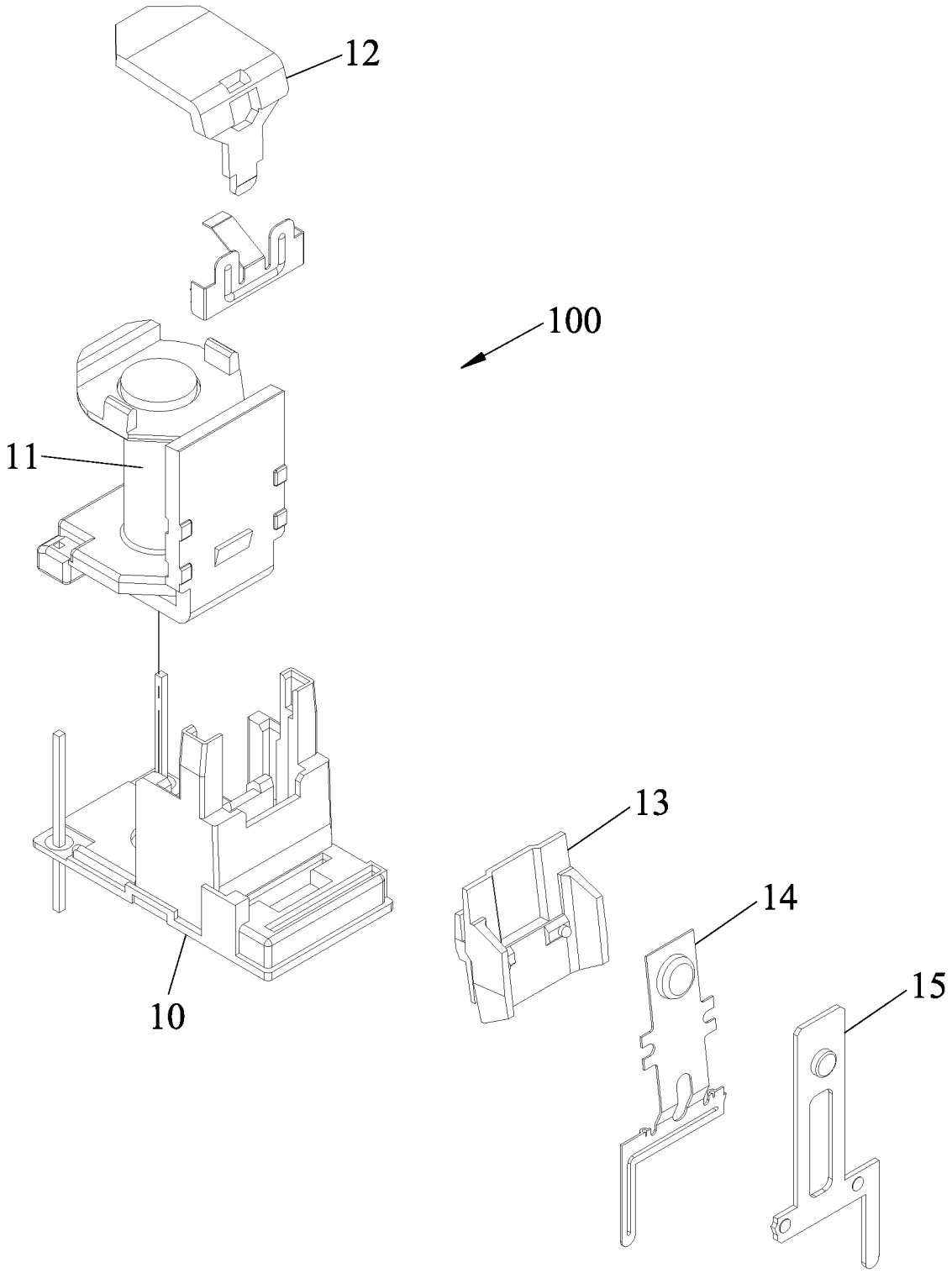
FIG.2 PRIOR ART
FIG. 2 is an exploded perspective view of the existing electromagnetic relay.
Figure 3:
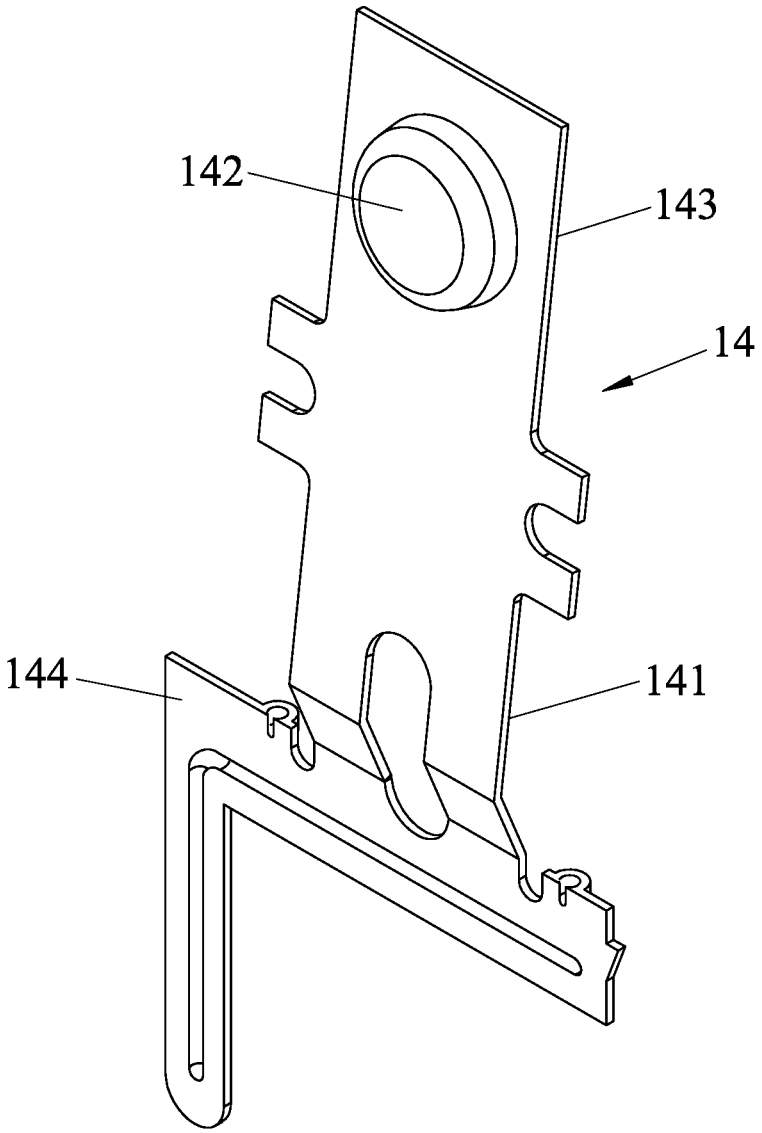
FIG.3 PRIOR ART
FIG. 3 is a perspective view of a movable terminal member of the existing electromagnetic relay.

The first leg 512 has a joining portion 516, and a leg portion 517 that extends downwardly from one end of the joining portion 516 and that is exposed from the base 2. The joining portion 516 has an engaging protrusion 518 formed into a rivet to be fixedly joined to the engaging hole 5150 of the connection portion 515, and a recess 519 that is formed in aback surface thereof opposite to the engaging protrusion 518 and that is aligned with the engaging protrusion 518 along a line perpendicular to the back surface. The number of each of the engaging protrusion 518 and the recess 519 in this embodiment is one, but may be two, three or more than three in other embodiment. As long as the number of the protrusion 518 corresponds with the number of the engaging hole 5150 and may be riveted thereto, any number thereof is acceptable. The first leg 512 has a thickness (t1) greater than a thickness (t2) of the spring plate 511. The thickness (tl) of the first leg 512 ranges from 0.3 mm to 0.5 mm. The thickness (t2) of the spring plate 511 ranges from 0.1 mm to 0.15 mm. A ratio of the thickness (tl) of the first leg 512 to the thickness (t2) of the spring plate 511 ranges from 2 to 4. In this embodiment, the ratio of the thickness (t1) of the first leg 512 to the thickness (t2) of the spring plate 511 is 3. Because the thickness (t1) of the first leg 512 is thicker than that of the leg 144 of the plate body 141 (see FIG. 3) of the prior art, a permissible current of the electromagnetic relay of this disclosure can be increased from a permissible current of 10 A to 25 A. Further, the spring plate 511 is also wider than that of the spring plate 143 (see FIG. 3) of the prior art, and is also more resilient than that of the prior art.

The stationary terminal member 6 is mounted on the base 2, is proximate to the movable terminal unit 5, and partly extends through the base 2. The stationary terminal member 6 has a second contact 62 facing and contactable with the first contact 52 to be in electrical conduction with each other.

Figure 9:
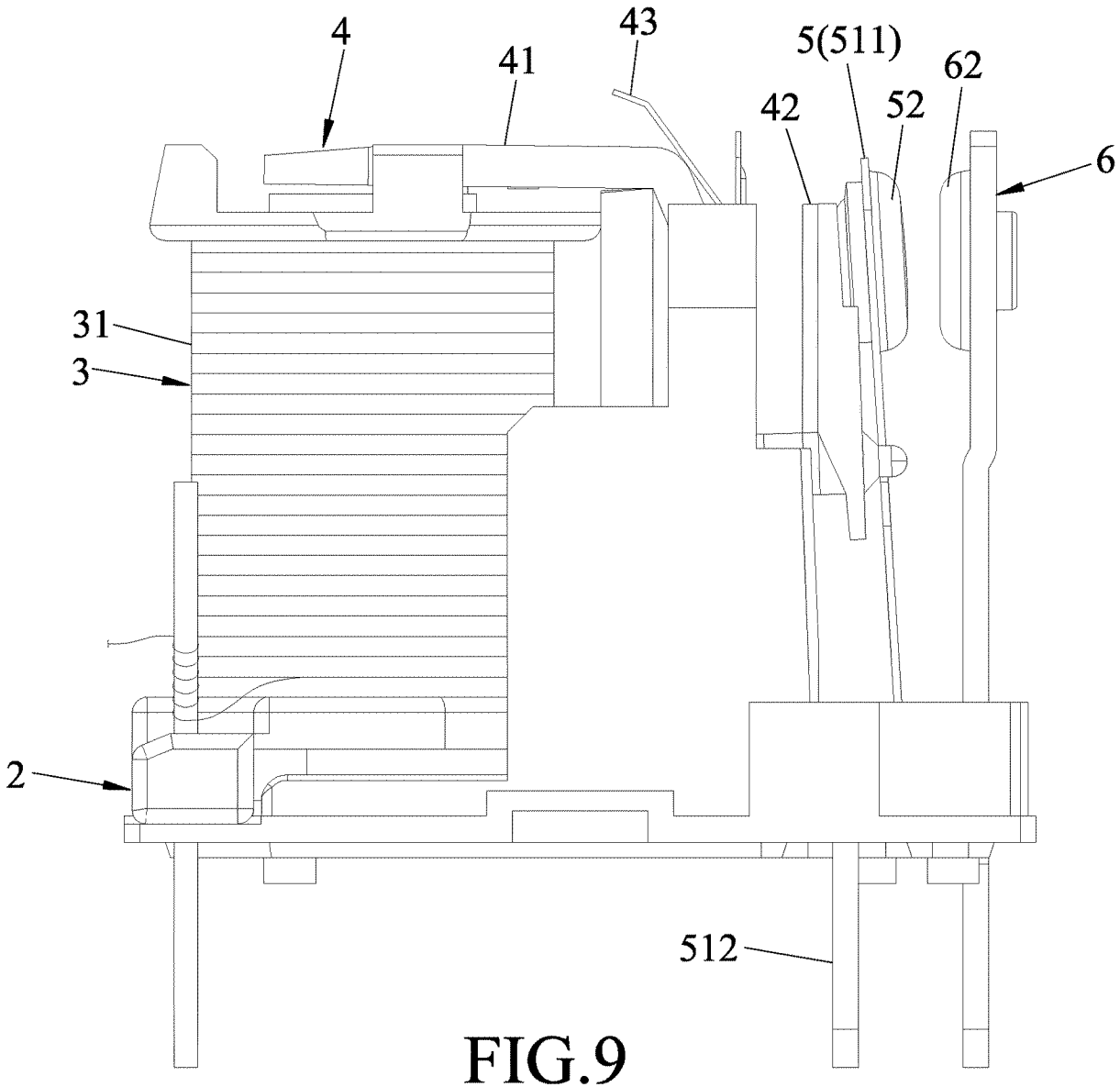
FIG. 9 is a side view of the embodiment, illustrating the movable terminal unit is spaced apart from a stationary terminal member when the electromagnetic relay is in a de-energized state.
Figure 10:
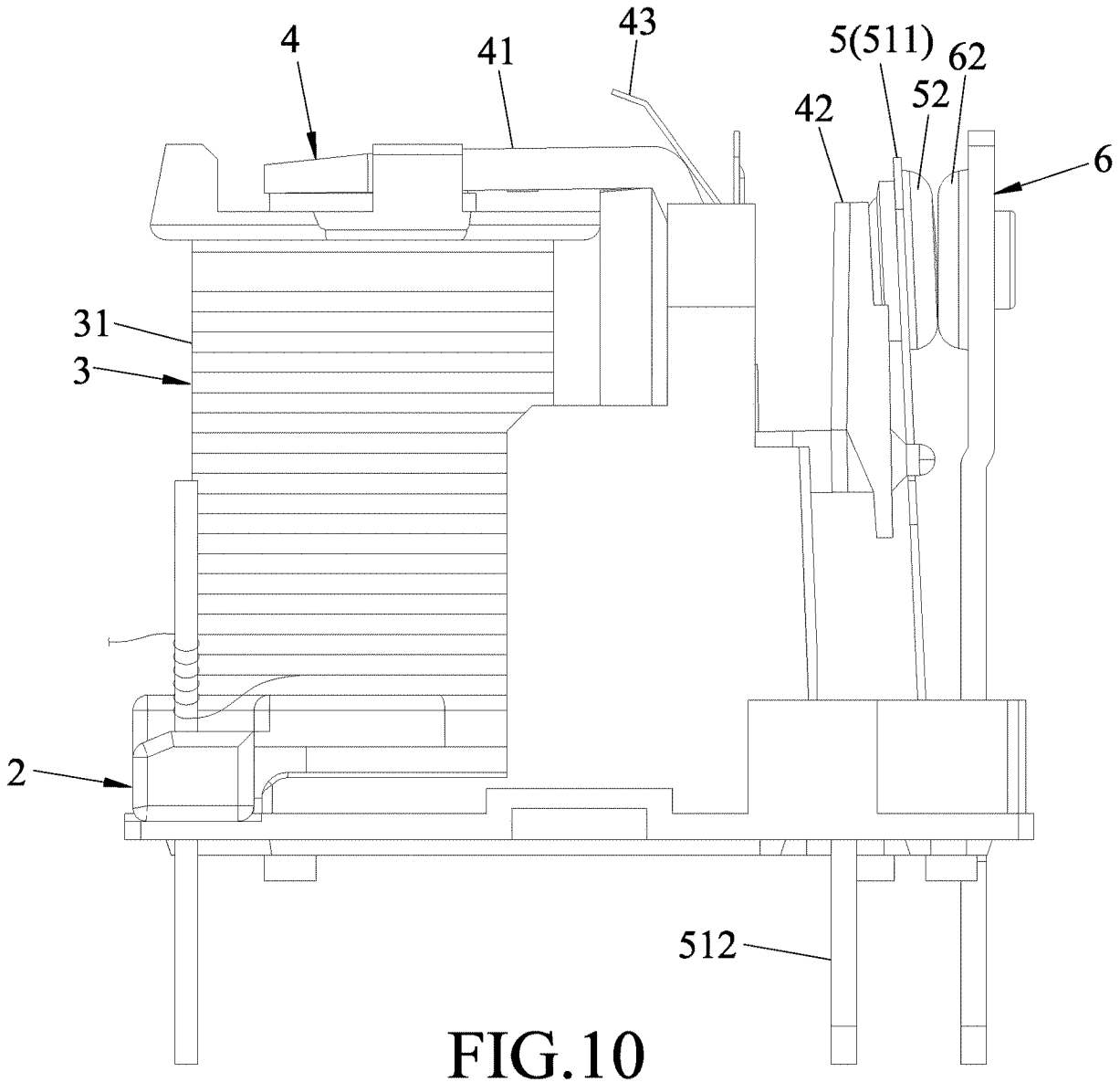
FIG. 10 is a view similar to FIG. 9, but illustrating the movable terminal unit in contact with the stationary terminal member when the electromagnetic relay is energized.

Referring to FIGS. 9 and 10, when the electromagnet 31 is energized (see FIG. 10), the magnetically attractive member 41 is magnetically attracted by the electromagnetic 31, and the push member 42 is driven by the magnetically attractive member 41 to move and resiliently push the spring plate 511 toward the stationary terminal member 6, so that the first contact 52 contacts the second contact 62. When the electromagnet 31 is de-energized (see FIG. 9), the resilient member 43 biases the magnetically attractive member 41 to move away from the electromagnet 31, and the push member 42 is driven by the magnetically attractive member 41 to move and resiliently pull the spring plate 511 away from the stationary terminal member 6, thereby moving the first contact 52 away from the second contact 62. Thus, the electromagnetic relay of this disclosure can allow a large current to flow therethrough.

Because the first terminal member 51 is composed of the spring plate 511 and the first leg 512 which are joined to form a two-piece structure, the thickness of the first leg 512 can be thickened without varying the thickness (t2) of the spring plate 511. Through this, the spring plate 511 can have a good elasticity and the permissible current can be increased. Further, the first included angle (θ1) is adjustable to obtain a desired elasticity, thereby enhancing the sensitivity of the electromagnetic relay of this disclosure.

Figure 11:
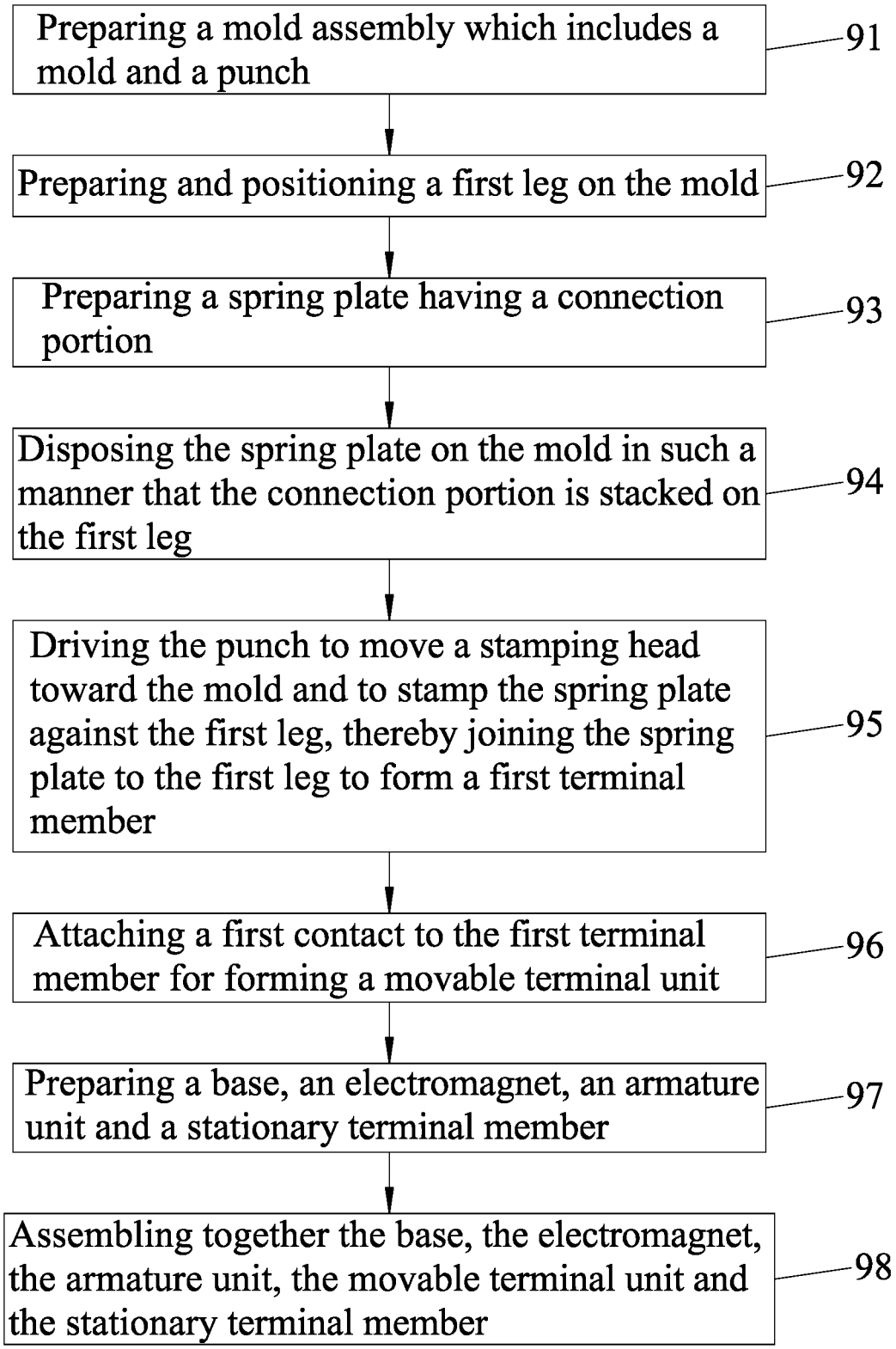
FIG. 11 is a flow chart, illustrating the steps involved in a method of making the electromagnetic relay of this disclosure.
Figure 12:
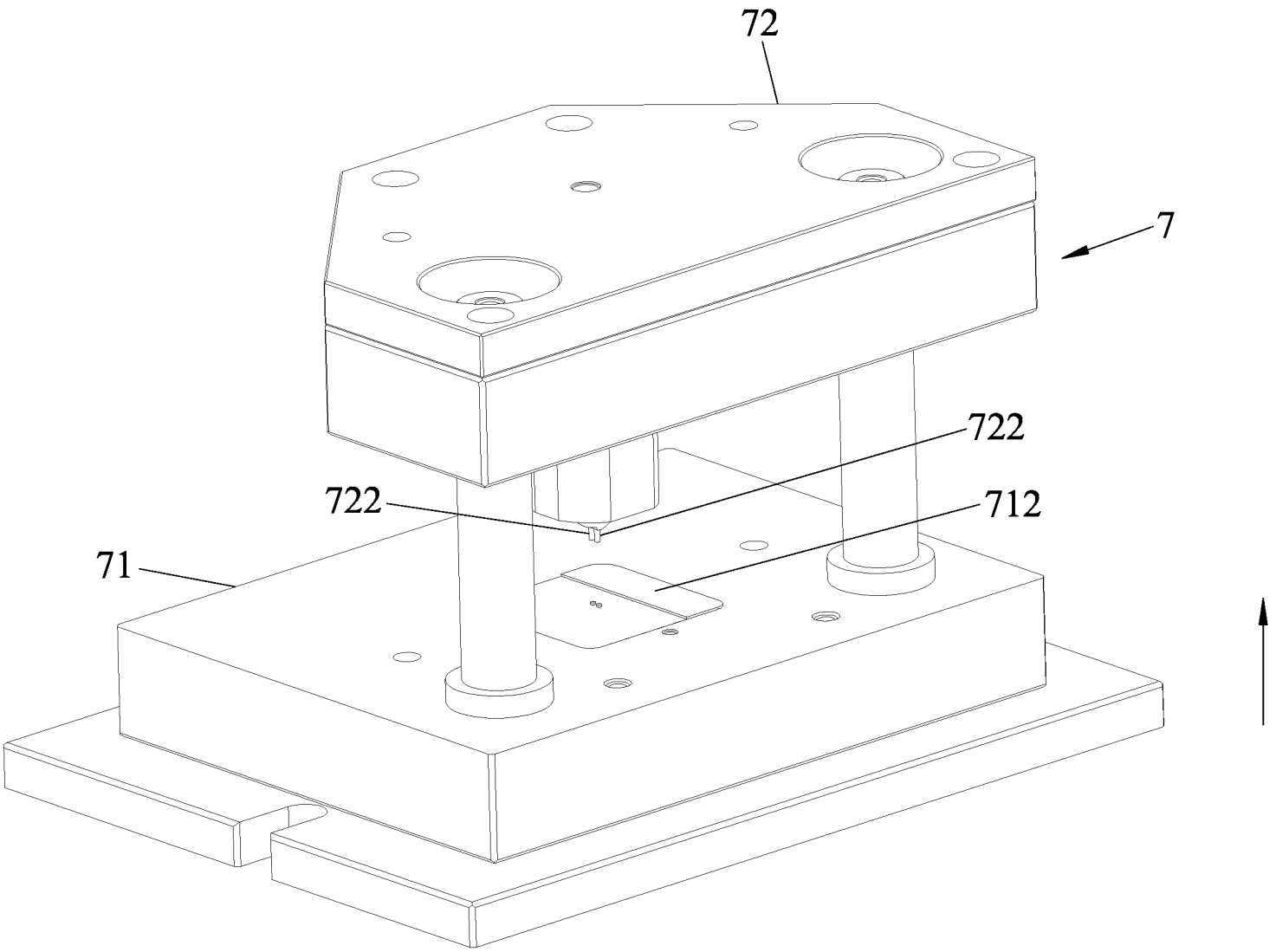
FIG. 12 is a perspective view of a mold assembly used in the method of making the electromagnetic relay of this disclosure.
Figure 13:
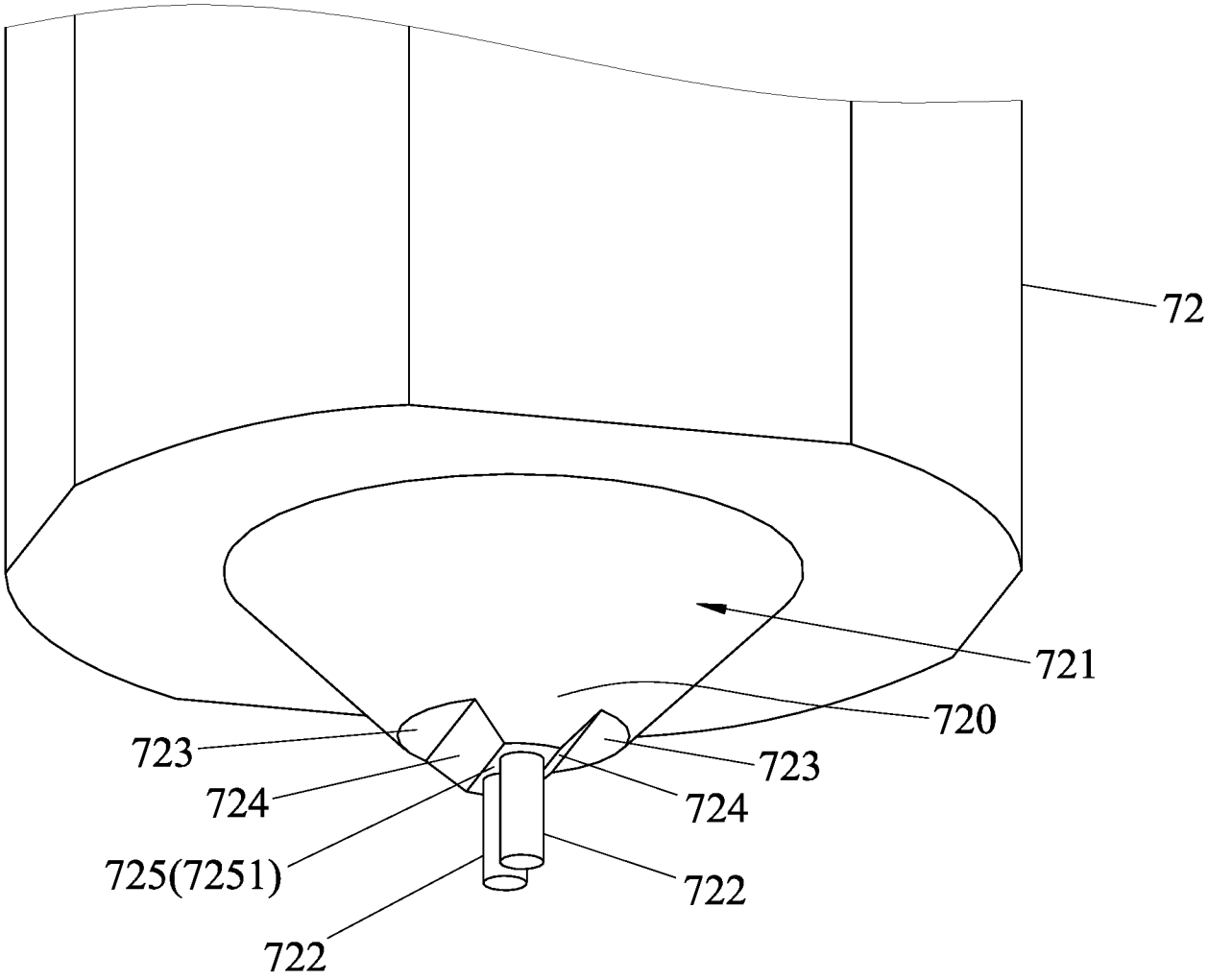
FIG. 13 is an enlarged fragmentary perspective view of a punch of the mold assembly.

Referring to FIG. 11, in combination with FIGS. 12 to 15, a method of making the electromagnetic relay according to the present disclosure is shown to include steps 91 to 98.

In step 91, a mold assembly 7 is prepared. The mold assembly 7 includes a mold 71, and a punch 72 movable relative to the mold 71. The mold 71 includes two positioning bosses 711 and a step portion 712 spaced apart from the positioning bosses 711. The step portion 712 has a height along a moving direction of the punch 72, which is greater than that of the positioning bosses 711. The punch 72 has a frusto-conical base 721 and two stamping heads 722. The frusto-conical base 721 has a tapered end 720 extending toward the mold 71. The tapered end 720 has two lateral flat portions 723 facing the mold 71, a middle region 725 which protrudes between the lateral flat portions 723 in a direction toward the mold 71 and which has a middle flat end face 7251 facing the mold 71, and two slope surfaces 724 sloping up respectively from the lateral flat portions 723 to the middle flat end face 7251. The stamping heads 722 extend downwardly from the middle flat end face 7251 and are spaced apart from each other.

Figure 14:
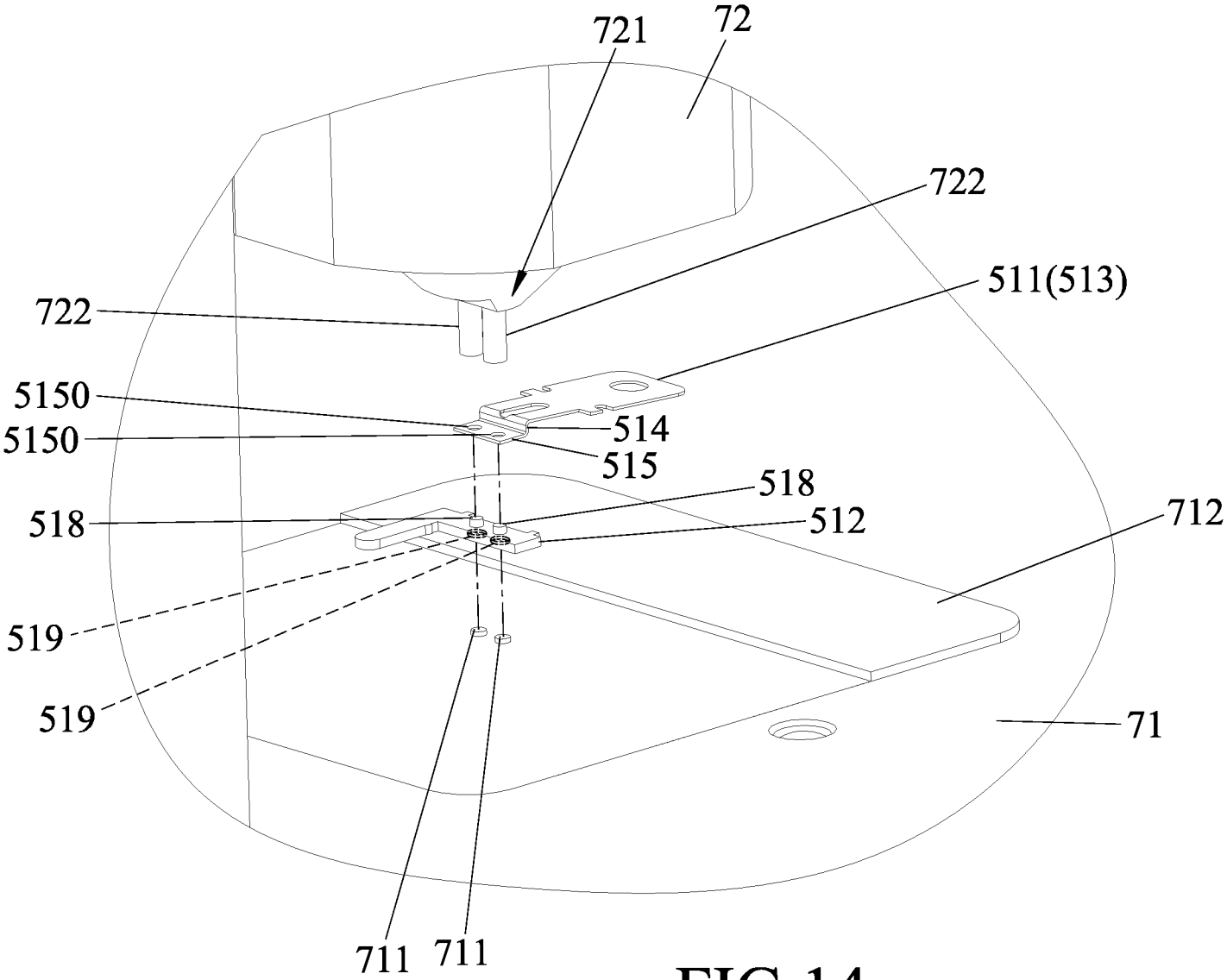
FIG. 14 is a fragmentary perspective view of the mold assembly, illustrating a spring plate and a first leg to be disposed on a mold of the mold assembly.

In step 92, the first leg 512 having two engaging protrusions 518 and two recesses 519 formed in the back surface thereof opposite to the engaging protrusions 518, as shown in FIG. 14, is prepared and is positioned on the mold 71 such that the recesses 519 respectively receive the positioning bosses 711 of the first leg 512. In other embodiments, a pin-and-hole engagement may be applied to achieve the effect of positioning the first leg 512 on the mold 71.

In step 93, the spring plate 511 having two engaging holes 5150 and the connection portion 515 is prepared. The spring plate 511 is made by stamping a metal sheet (not shown).

In step 94, the spring plate 511 is disposed on the mold 71 such that the operation portion 513 thereof is supported by the step portion 712, and the engaging holes 5150 thereof respectively receive the engaging protrusions 518 of the first leg 512. That is, the connection portion 515 of the spring plate 511 is stacked on the first leg 512.

Figure 15:
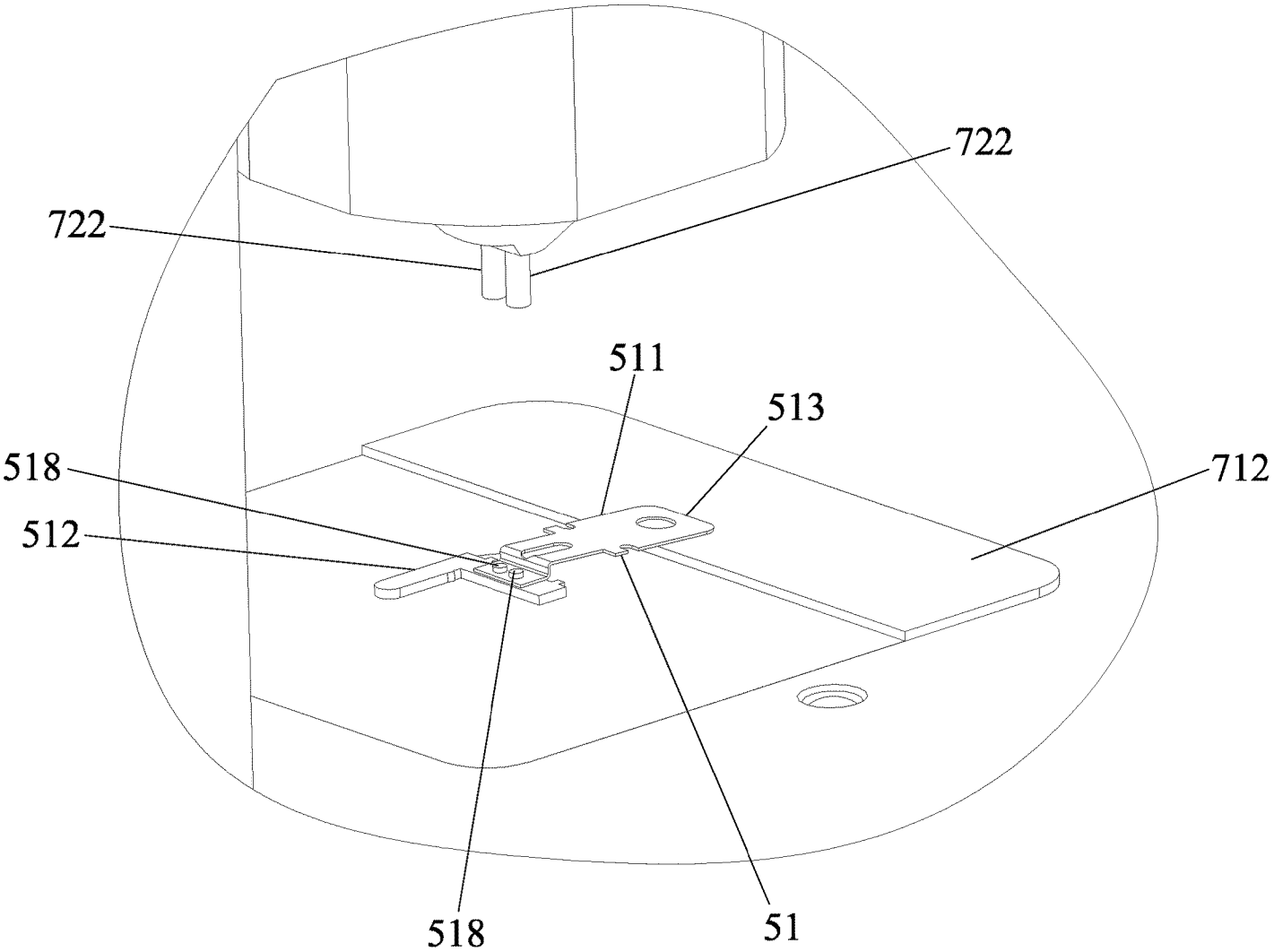
FIG. 15 is a view similar to FIG. 14, but illustrating the spring plate and the first leg being disposed on the mold of the mold assembly.

In step 95, the punch 72 is driven to move the stamping heads 722 toward the mold 71, as shown in FIG. 15, and to stamp the spring plate 511 against the first leg 512, thereby joining the spring plate 511 to the first leg 512 to form the first terminal member 51.

Specifically, the step of driving the punch to move the stamping heads 722 toward the mold 71 includes stamping the engaging protrusions 518 to form each engaging protrusion 518 into a rivet so that the spring plate 511 is riveted to the first leg 512. By virtue of the frusto-conical base 721 having the lateral flat portions 723 and the slope surfaces 724, the first and second included angles (θ1, θ2) of the spring plate 511 are prevented from being damaged during the stamping process.

In step 96, the first contact 52 is attached to the first terminal member 51 to form the movable terminal unit 5.

In step 97, the base 2, the electromagnet 31, the armature unit 4 and the stationary terminal member 6 are prepared.

In step 98, the base 2, the electromagnet 31, the armature unit 4, the movable terminal unit 5 and the stationary terminal member 6 are assembled together to form the electromagnetic relay of this disclosure.

Notably, the method of making the electromagnetic relay of this disclosure involves riveting the spring plate 511 and the first leg 512 to form the first terminal member 51 having a two-piece structure. In other embodiment, the spring plate 511 and the first leg 512 may be joined together by other joining methods, such as welding or soldering.

In sum, since the electromagnetic relay made from the method of this disclosure has the first terminal member 51 with a two-piece structure, by only increasing the thickness (tl) of the first leg 512, the permissible current of the electromagnetic relay of this disclosure can be increased, and the resiliency of the spring plate 511 can be maintained.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electromagnetic relay, comprising:

a base;

an electromagnet unit including an electromagnet disposed on said base;

an armature unit movably connected to said electromagnet, and including a magnetically attractive member magnetically attractable by said electromagnet;

a movable terminal unit mounted on said armature unit, and including a first terminal member and a first contact disposed on said first terminal member, said first terminal member being a two-piece structure composed of a spring plate, and a first leg fixedly joined to said spring plate and extending through said base, said spring plate having an operating portion connected to said armature unit, a bent portion bent from said operating portion toward said electromagnet, and a connection portion bent from said bent portion and fixed to said first leg, said operating portion and said bent portion forming therebetween a first included angle ranging from 75 degrees to 85 degrees, said bent portion and said connection portion forming therebetween a second included angle ranging from 80 degrees to 95 degrees, said first leg having a thickness greater than a thickness of said spring plate, a ratio of the thickness of said first leg to the thickness of said spring plate ranging from 2 to 4; and a stationary terminal member mounted on said base and partly extending through said base, said stationary terminal member having a second contact facing and contactable with said first contact;

wherein, when said electromagnet is energized and drives said armature unit to push said spring plate, said spring plate resiliently moves toward said stationary terminal member, and said first contact contacts said second contact; and wherein, when said electromagnet is de-energized, said first contact moves away from said second contact.

2. The electromagnetic relay as claimed in claim 1, wherein said armature unit further includes a push member connected to said magnetically attractive member and spaced apart from said electromagnet, said push member having two positioning studs engaging with said operating portion of said spring plate.

3. The electromagnetic relay as claimed in claim 1, wherein said connection portion of said spring plate has at least one engaging hole, said first leg having at least one engaging protrusion fixedly joined to said at least one engaging hole.

4. The electromagnetic relay as claimed in claim 3, wherein said at least one engaging protrusion is formed into a rivet to be fixedly joined to said at least one engaging hole.

5. The electromagnetic relay as claimed in claim 3, wherein said first leg further has a recess that is formed in a back surface thereof opposite to said at least one engaging protrusion and that is aligned with said at least one engaging protrusion along a line perpendicular to said back surface.

6. A method of making the electromagnetic relay as claimed in claim 1, comprising:

preparing a mold assembly that includes a mold, and a punch movable relative to the mold, the punch having at least one stamping head;

preparing and positioning the first leg on the mold;

preparing the spring plate having the connection portion;

disposing the spring plate on the mold in such a manner that the connection portion of the spring plate is stacked on the first leg;

driving the punch to move the stamping head toward the mold and to stamp the spring plate against the first leg, thereby joining the spring plate to the first leg to form the first terminal member;

attaching the first contact to the first terminal member for forming the movable terminal unit;

preparing the base, the electromagnet, the armature unit and the stationary terminal member; and assembling together the base, the electromagnet, the armature unit, the movable terminal unit and the stationary terminal member.

7. The method as claimed in claim 6, wherein:

the first leg has at least one engaging protrusion, and at least one recess formed in a back surface thereof opposite to the at least one engaging protrusion, the mold including at least one positioning boss, the spring plate having at least one engaging hole;

the step of positioning the first leg on the mold includes placing the first leg on the mold such that the at least one positioning boss extends into the at least one recess;

the step of disposing the spring plate on the mold includes causing the at least one engaging protrusion of the first leg to extend into the at least one engaging hole of the spring plate.

8. The method as claimed in claim 6, wherein the spring plate further has an operating portion, the mold further including a step portion to support the operating portion, the step portion having a height along a moving direction of the punch, which is greater than that of the at least one positioning boss.

9. The method as claimed in claim 6, wherein the punch further has a frusto-conical base that has a tapered end extending toward the mold, the tapered end having two lateral flat portions facing the mold, a middle region which protrudes between the lateral flat portions in a direction toward the mold and which has a middle flat end face facing the mold, and two slope surfaces sloping up respectively from the lateral flat portions to the middle flat end face, the stamping head extending downwardly from the middle flat end face.

10. The method as claimed in claim 6, wherein the step of driving the punch to move the stamping head toward the mold includes stamping the engaging protrusion to form the engaging protrusion into a rivet so that the spring plate is riveted to the first leg.

* * * * *